US005421596A

United States Patent [19]

Lee

[11] Patent Number: 5,421,596

[45] Date of Patent: Jun. 6, 1995

[54] ROLLER SKATE WITH CONVERTIBLE WHEEL CONFIGURATION

[75] Inventor: Fang-Liang Lee, San Chung City, Taiwan, Prov. of China

[73] Assignee: Yuh Jou Co., Ltd., Taipei Hsien, Taiwan, Prov. of China

[21] Appl. No.: 257,720

[22] Filed: Jun. 10, 1994

[51] Int. Cl.[6] ..... A63C 17/02; A63C 17/04; A63C 17/26

[52] U.S. Cl. ..... 280/11.19; 280/11.2; 280/11.23; 280/11.26; 280/11.27; 280/7.13

[58] Field of Search ..... 280/7.13, 7.14, 11.16, 280/11.19, 11.26, 11.2, 11.22, 11.23, 11.27, 11.31, 7.1

[56] References Cited

U.S. PATENT DOCUMENTS

| | | | |
|---|---|---|---|
| 177,566 | 5/1876 | Saladee | 280/11.19 |
| 1,696,597 | 12/1928 | Fergusson | 280/11.16 |
| 1,807,890 | 6/1931 | Berger | 280/11.27 X |
| 1,830,514 | 11/1931 | Joslin | 280/7.13 X |
| 2,927,797 | 3/1960 | Jones et al. | 280/11.26 |
| 3,086,787 | 4/1963 | Wyche | 280/11.19 |
| 3,901,520 | 8/1975 | McMahan | 280/11.19 X |
| 3,936,061 | 2/1976 | Wada | 280/11.26 X |
| 3,993,318 | 11/1976 | Rothmayer | 280/7.13 X |
| 4,304,417 | 12/1981 | Hsieh | 280/11.26 |
| 4,666,169 | 5/1987 | Hamill et al. | 280/11.23 |
| 5,092,614 | 3/1992 | Malewicz | 280/11.27 X |
| 5,277,437 | 1/1994 | Moats | 280/11.27 X |

FOREIGN PATENT DOCUMENTS

| | | | |
|---|---|---|---|
| 0349943 | 1/1990 | European Pat. Off. | 280/11.23 |
| 901982 | 4/1945 | France | 280/11.19 |
| 1518914 | 3/1968 | France | 280/7.13 |
| 572985 | 2/1958 | Italy | 280/11.19 |
| 542 | of 1876 | United Kingdom | 280/11.19 |

*Primary Examiner*—Brian L. Johnson
*Attorney, Agent, or Firm*—Bacon & Thomas

[57] ABSTRACT

An improved structure for roller skate in which the installation and the structure of the single-row rollers are improved. The in-line rollers in the conventional roller skate are redesigned so that the rollers can be installed on the left and the right hand sides of the shoes to form a dual-row roller skate. The structure can also be modified to have a single roller in the front and dual rollers in the rear, or the rollers of the structure can also be arranged in a single row. Such configuration allows a beginner to use a dual-row four-wheel roller skate for balanced practice, and then the roller skate can be changed into a three-wheel type when the user is in his intermediate stage. Finally, the user can be advanced by using the two-wheel in-line structure. The entire practicing process requires only one pair of roller skates, therefore, it is an economical and practical roller skate structure.

3 Claims, 3 Drawing Sheets

ROLLER SKATE WITH CONVERTIBLE WHEEL CONFIGURATION

BACKGROUND OF THE INVENTION (a) Field of the Invention

The present invention relates to an improved structure for a roller skate, particularly a roller skate in which the installation of the rollers is improved to provide an economical and practical roller skate structure.

(b) Description of the Prior Art

Conventional roller skates currently available are either of the single-row rollers or dual-row rollers type. The dual-row type roller skate has four wheels and is better supported for use by a majority of the beginners. The dual-row four-wheel roller skates are also safer to skate on. The wheels in the single-row roller skate form a line which is not well supported on the floor, therefore, the single-row roller skates are used by experienced skaters. However, the beginner, even after gaining experience from the four-wheel roller skate, has found that using the single-row roller skate is not easy. Moreover, the structure of all the roller skates currently available are fixed and cannot be modified. Therefore, a pair of single-row and a pair of dual-row roller skates are needed. This costs more and is impractical.

SUMMARY OF THE INVENTION

The main object according to the present invention is to provide an improved structure for a pair of roller skates in which the wheels can be installed on the left and the right hand side of the shoe body, so as to form a roller skate with dual rows of wheels. The structure can be used by a beginner. When the beginner gains some experience, the structure can be modified to have a different configurations. By such design, a user can use the dual row of wheels for elementary practice. The user then gradually advances to use the three-wheel and the two-wheel roller skates. For learning, entertainment and exercising purpose, only one pair of roller skates is needed. This makes it more economical and practical for roller skating.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENTS

Figure 1:
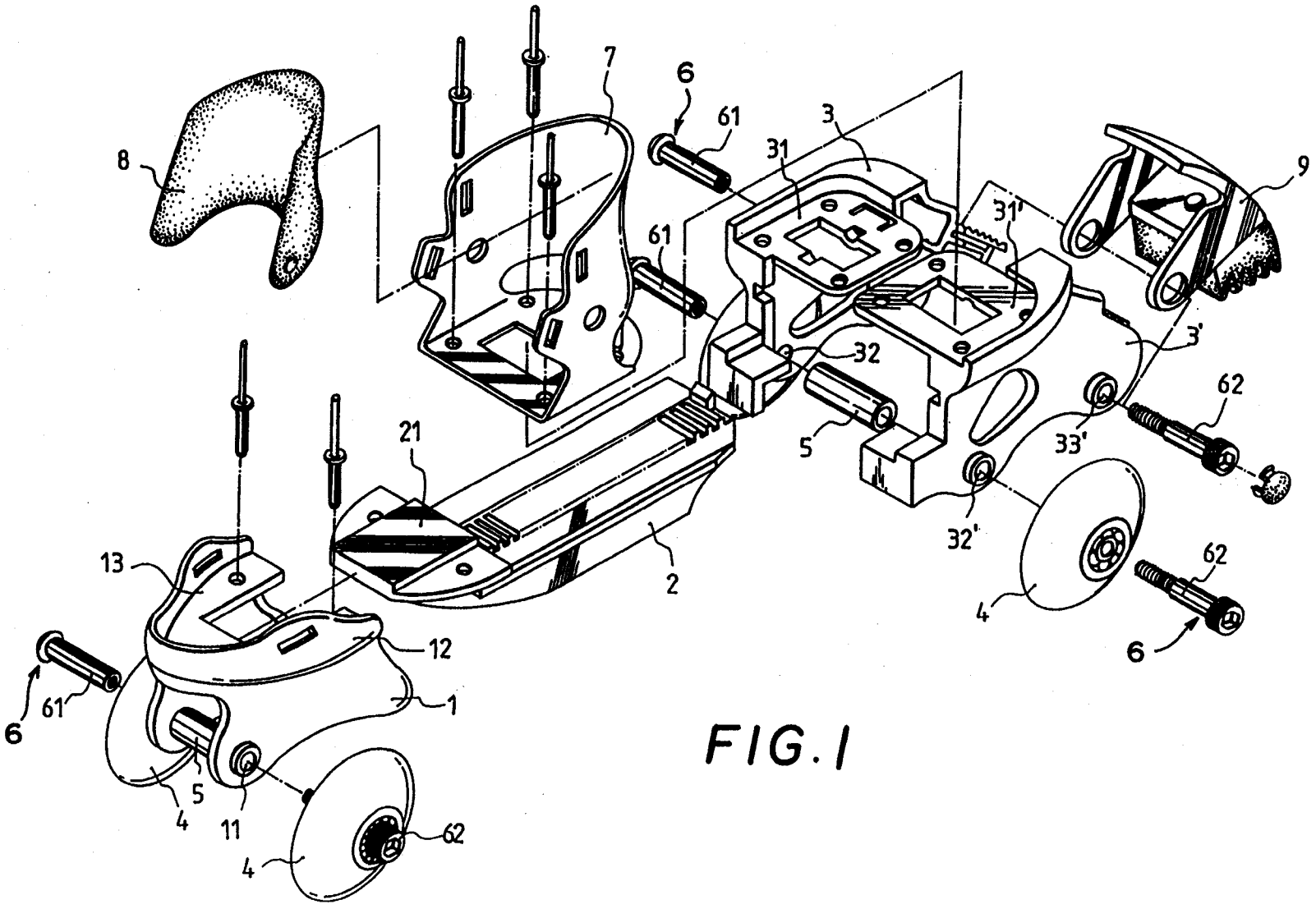
FIG. 1 is a perspective exploded view of the improved roller skate according to one embodiment the present invention.
Figure 2:
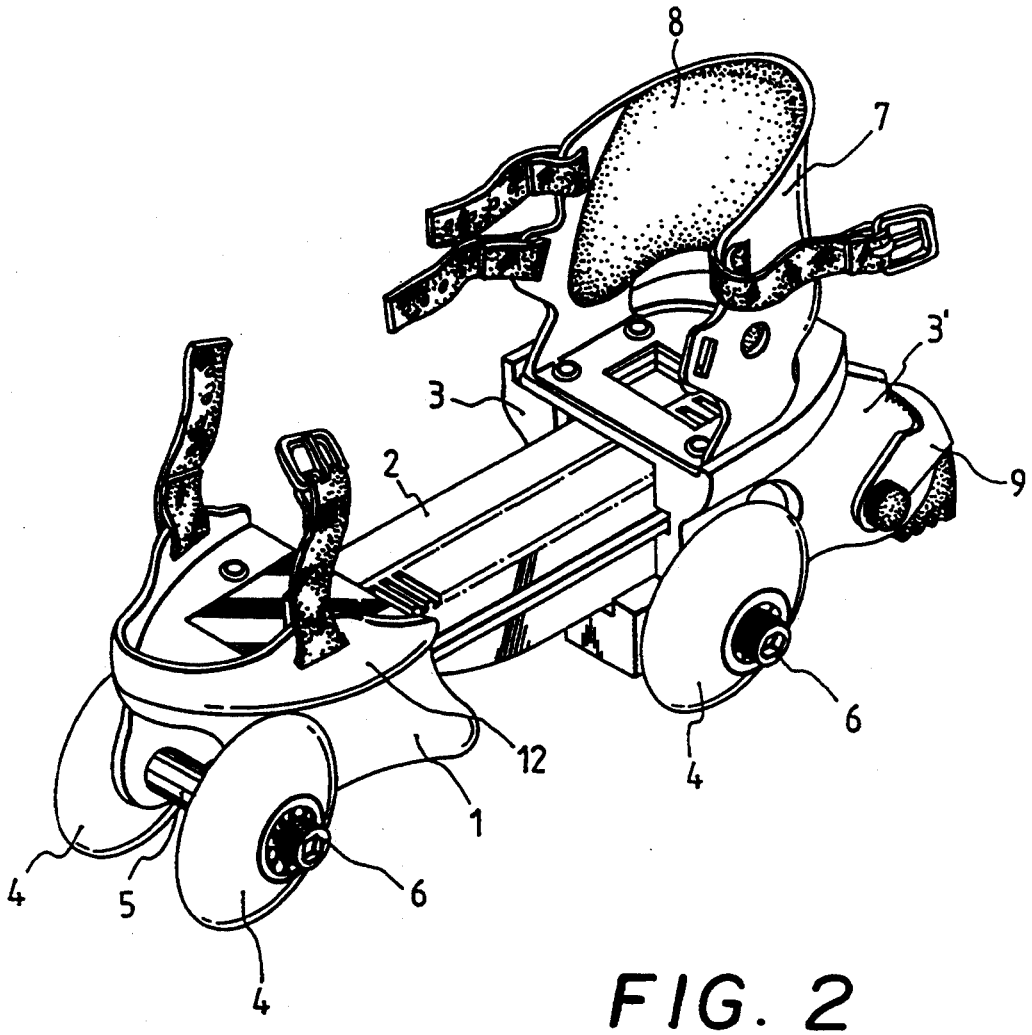
FIG. 2 is a perspective view of a preferred embodiment having four wheels arranged in two rows in the roller skate assembly according to the present invention.

As shown in FIGS. 1 and 2, the structure for the roller-type shoe skate according to the present invention mainly consists of a front body (1) a shoe rod (2), a pair of left and fight rear bodies (3), (31), a plurality of rollers (4), sleeves (5) and plural axle bolt sets (6). The lower portion of the front body (1) is a housing, the front end of which is provided with a pair of axle holes (11). The top half portion of the front body (1) is a shoe toe (12), and the rearward section of the front body (1) is provided with a connecting slot (13) into which a connecting portion (21) of the shoe rod (2) is secured thereto. The shoe rod (2) is a strip body, the front of which is provided with the connecting portion (21), which is secured with the front body (1). The rearward portion of the shoe rod (2) is movably connected with the left and the right rear bodies (3) and (31). The left and the right rear bodies (3) and (31) are symmetrical with each other. Recessed surfaces (31) and (311) provided in the top surface of the rear bodies (3) and (31) coincide with each other. Underneath the recessed surfaces (31) and (31,) there are corresponding axle holes (32) and (321), the rearward end of which are provided with spare axle holes (33) and (331).

Figure 3:
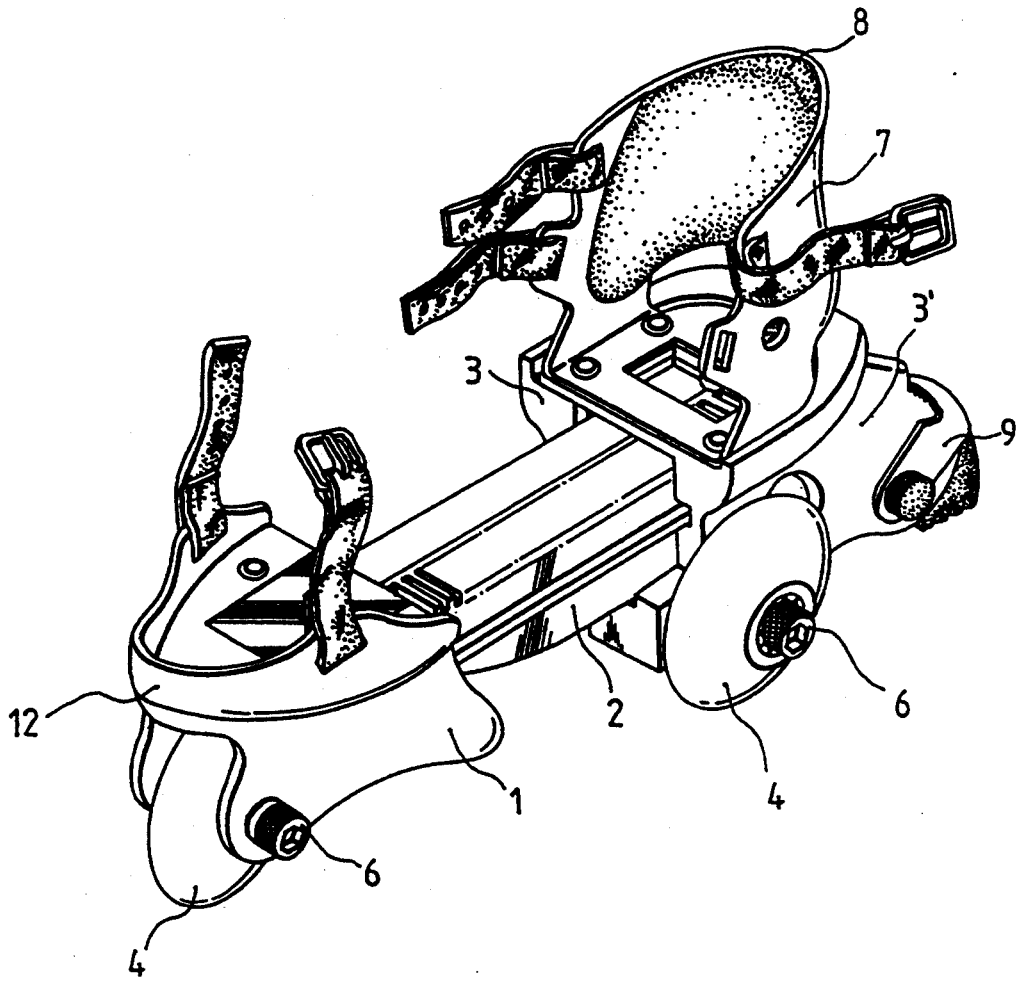
FIG. 3 is a perspective view of another preferred embodiment having three wheels arranged in a triangular shape in the roller skate assembly according to the present invention.

By such configuration, the connecting portion (21) at the forward end of the shoe rod (2) is secured with the front body (1). The sleeve (5) is retained in between the axle holes (11) provided underneath the front body (1) and is used as a bearing sleeve. The two rollers (4) are installed on the external side of the axle holes (11) of the front body (1). An axle bolt (61) of the axle bolt set (6) is used to feed through the two rollers (4), and then a nut (62) is used on each of the rollers (4) to secure the axle bolt (61) in place, thereby allowing the rollers (4) to be rotated freely. The left and the fight rear bodies (3), (3') are then put together, and their recessed surfaces (31), (311) coincide and secure with each other. The sleeve (5) is retained in between the corresponding axle holes (32), (32') of the rear bodies (3), (31) and is used as a bearing sleeve. Two rollers (4) are then installed on the external sides of the axle holes (32) and (32'). Another axle bolt (61) of the axle bolt set (6) is used to feed through the two rollers (4), and again another nut (62) is used on each of the rollers (4) so as to secure the axle bolt (61) in place, thereby allowing the rollers (4) to rotate freely. At the same time, a rear heel casing (7) is then disposed and secured on the recessed surfaces (31), (31'), a padding (8) is provided inside the heel casing (7). Moreover, a brake pad (9) can be secured on the rearward end of the rear bodies (3), (31). The shoe rod (2) is then guided and inserted into the rear bodies and is secured thereto. This completes the assembly of the roller skate having four rollers arranged in two rows. In addition, the rollers (4) of the front body (1) can be removed and only one roller can be installed in the corresponding axle holes (11), thereby forming a 3-wheel roller skate having the wheels arranged in a triangular fashion, as shown in FIG. 3. Furthermore, the rollers (4) attached to the rear bodies (3), (3') can be replaced by a single roller, with the embodiment relating to the roller (4) in the rear bodies being similar to that in the front body. It can be seen that the roller skate according to the present invention is very suitable for beginners as well as experienced skaters. Not only that it is a very practical design structure because there is no need to purchase another pair of roller skate with a different wheel arrangement, and the structure is also very economical.

Although the invention has been described in its preferred form with a certain degree of particularity it is understood that the present disclosure of the preferred form has been made only by way of example and numerous changes in the details of construction and the combination and arrangement of parts may be resorted to without departing from the spirit and the scope of the invention as hereinafter claimed. It is intended that the patent shall cover, by suitable expression in the appended claims, whatever features of patentable novelty exists in the invention disclosed.

What is claimed is:

1. A roller skate with convertible wheel configuration comprising:

a) a front body, a pair of symmetrical left and right rear bodies, a shoe rod including a front end provided with a connecting portion and a rear end, and a plurality of rollers;

b) the front body including a lower portion forming a housing having a pair of spaced front walls with a pair of front axle holes formed therein, a top front portion forming a shoe toe, and a rear portion provided with a connecting slot for engagement with the connecting portion of the shoe rod;

c) a front axle set including an axle bolt, a sleeve and a nut, the front axle set being detachably secured through the front axle holes for selectively permitting the mounting of either a pair of rollers on exterior sides of the spaced front walls or a single roller between interior sides of the spaced front walls;

d) the rear bodies each including a recessed top surface, the recessed top surfaces coinciding with each other, a pair of rear axle holes formed in the rear bodies below the recessed top surfaces, and the rear end of the shoe rod having means for movably securing the shoe rod to the rear bodies.

e) a rear axle set including an axle bolt, a sleeve and a nut detachably secured through the rear axle holes for selectively permitting the mounting of either a pair of rollers on exterior sides of the rear bodies or a single roller between interior sides of the rear bodies; and f) a heel casing secured to the top recessed surfaces of the rear bodies.

2. The roller skate of claim 2 wherein the rear bodies further include a pair of auxiliary axle holes formed therein, the auxiliary axle holes being disposed rearwardly of the rear axle holes, a brake pad, and an auxiliary axle set engagable with the auxiliary axle holes for securing the brake pad to the rear bodies.

3. The roller skate of claim 1 further including a padding disposed within the heel casing.

* * * * *